US010066844B2

(12) United States Patent
Murakami

(10) Patent No.: US 10,066,844 B2
(45) Date of Patent: Sep. 4, 2018

(54) HEATING ELEMENT COVER COMPONENT, HEATING ELEMENT COVER, RADIANT COOLING AND HEATING APPARATUS, AND AIR CONDITIONING SYSTEM

(71) Applicant: Eco Factory Co., Ltd., Kumamoto-shi, Kumamoto (JP)

(72) Inventor: Takanobu Murakami, Kumamoto (JP)

(73) Assignee: ECO FACTORY CO., LTD., Kumamoto-Shi (JP)

( * ) Notice: Subject to any disclaimer, the term of this patent is extended or adjusted under 35 U.S.C. 154(b) by 421 days.

(21) Appl. No.: 15/022,964

(22) PCT Filed: Mar. 2, 2016

(86) PCT No.: PCT/JP2016/056366
§ 371 (c)(1),
(2) Date: Mar. 18, 2016

(87) PCT Pub. No.: WO2017/149692
PCT Pub. Date: Sep. 8, 2017

(65) Prior Publication Data

US 2018/0087787 A1 Mar. 29, 2018

(51) Int. Cl.
*F24F 5/00* (2006.01)
*F28F 1/20* (2006.01)

(52) U.S. Cl.
CPC ..... *F24F 5/0089* (2013.01); *F28F 1/20* (2013.01); *F28F 2275/14* (2013.01)

(58) Field of Classification Search
CPC ..... F25F 1/20; F25F 2275/14; F25F 5/0089; F25F 1/30
See application file for complete search history.

(56) References Cited

U.S. PATENT DOCUMENTS 3,735,465 A * 5/1973 Tibbetts ..... B21C 37/225 165/183
4,241,727 A * 12/1980 Toti ..... F28F 1/20 126/659

(Continued)

FOREIGN PATENT DOCUMENTS

CA 2 843 925 A1 1/2015
CN 204717236 U 10/2015

(Continued)

OTHER PUBLICATIONS

Taiwan Patent Office, Office Action and Search Report, issued in TW Patent Application No. 105107909, which is a Taiwanese counterpart of U.S. Appl. No. 15/022,964, dated Aug. 10, 2017, 6 pages (2 pages of English translation, 3 pages of Office Action, and 1 page of Search Report).

(Continued)

*Primary Examiner* — Cassey D Bauer

(57) ABSTRACT

A heating element cover component includes a hollow outer shell portion of a required length, having required rigidity and thermal conductivity, a substantially half-pipe shaped abutting portion formed with a required thickness on the outside of the outer shell portion in a longitudinal direction of the outer shell portion, having flexibility and thermal conductivity, and with a slit penetrating in a thickness direction formed over the entire length in the longitudinal direction, a connecting portion having flexibility and thermal conductivity, connecting opposed edges of the abutting portion in the longitudinal direction with the outer shell portion, and an engaging portion constituted with a projecting piece and a projecting piece inserting portion being engaging elements disposed at line-symmetrical positions using a longitudinal straight line located at a widthwise (Continued)

middle of the abutting portion as an axis of symmetry to form a pair structured to be engageable with each other.

6 Claims, 9 Drawing Sheets

(56) References Cited

U.S. PATENT DOCUMENTS

| | | | | |
|---|---|---|---|---|
| 7,992,623 | B2 * | 8/2011 | Keller | F24D 3/142 165/49 |
| 2013/0000877 | A1 * | 1/2013 | Bauer | F28F 1/20 165/177 |
| 2015/0338108 | A1 * | 11/2015 | Murakami | F24F 5/0089 165/49 |

FOREIGN PATENT DOCUMENTS

| | | | |
|---|---|---|---|
| EP | 2 868 986 | A1 | 5/2015 |
| JP | 2002-130704 | A | 5/2002 |
| JP | 2002-130704 | A1 | 5/2002 |
| JP | 5544580 | B1 | 5/2014 |
| JP | 2015-025627 | A | 2/2015 |
| KR | 101102526 | B1 | 7/2011 |
| TW | M287919 | U | 2/2006 |
| WO | 2005/045296 | A1 | 5/2005 |

OTHER PUBLICATIONS

Canadian Intellectual Property Office, "Office Action," issued in Canadian Patent Application No. 2,924,556, which is a Canadian counterpart of U.S. Appl. No. 15/022,964, with an issuance date of Jan. 11, 2017, 3 pages.

* cited by examiner

[ Fig. 1]
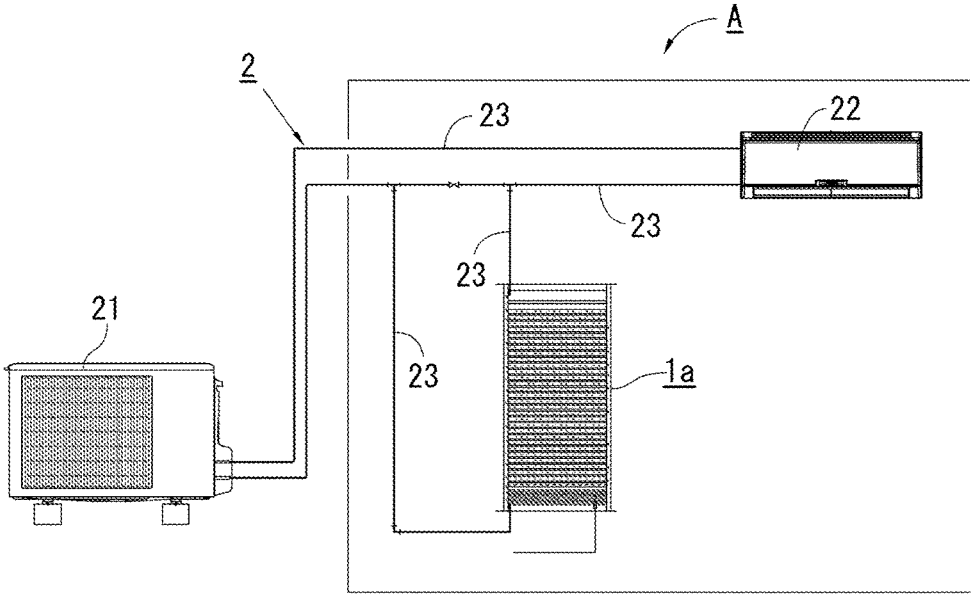

[ Fig. 2]
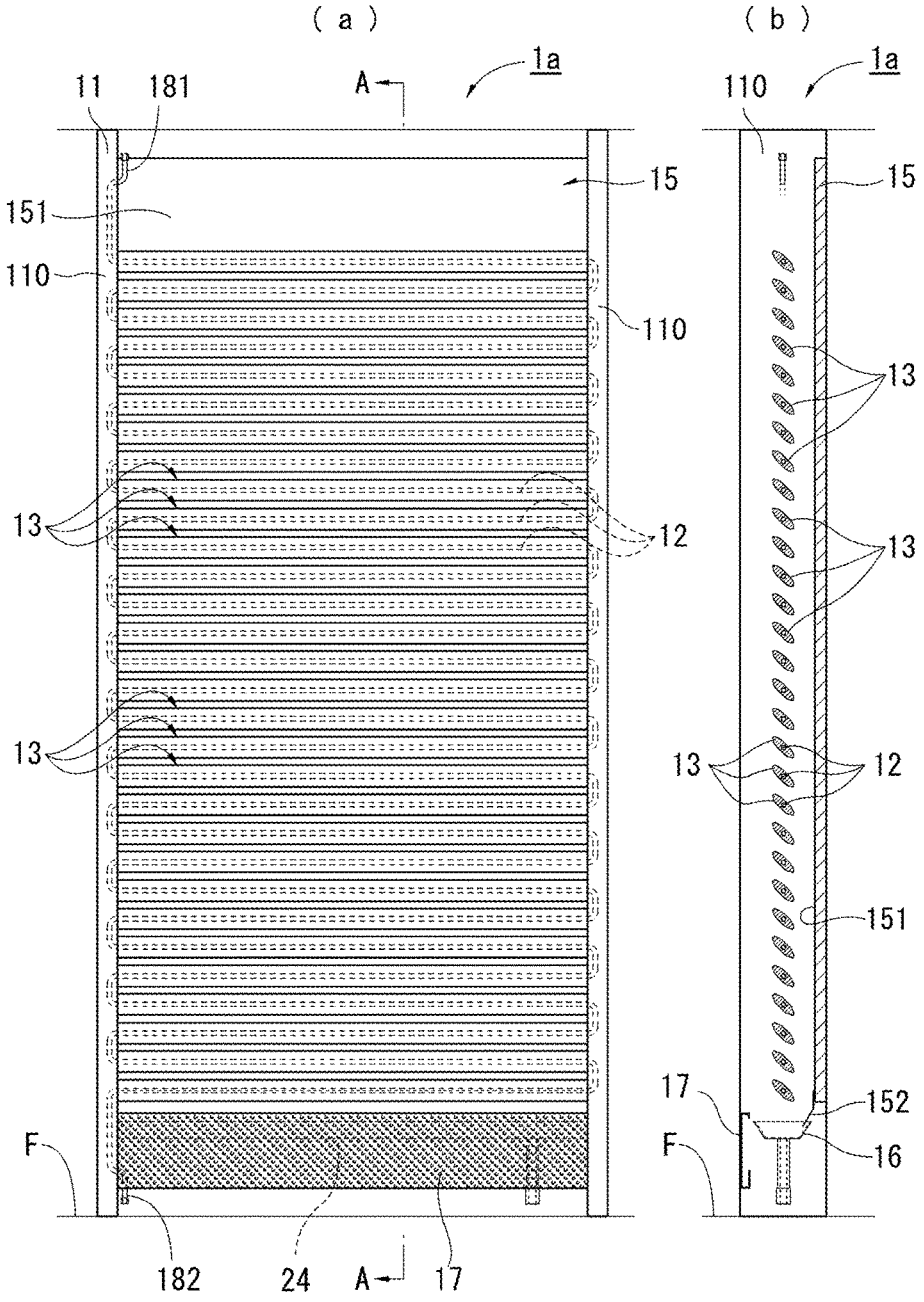

[ Fig. 3]
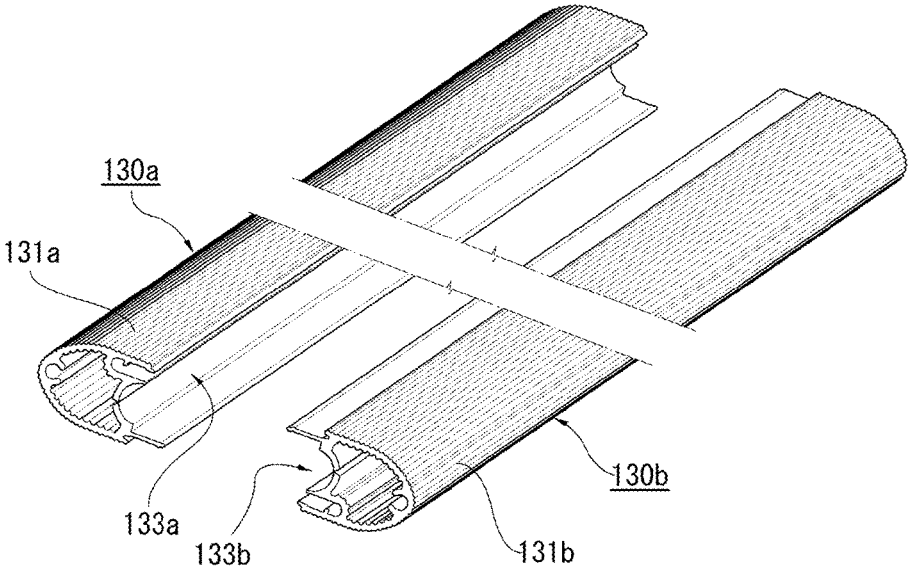
[ Fig. 4]
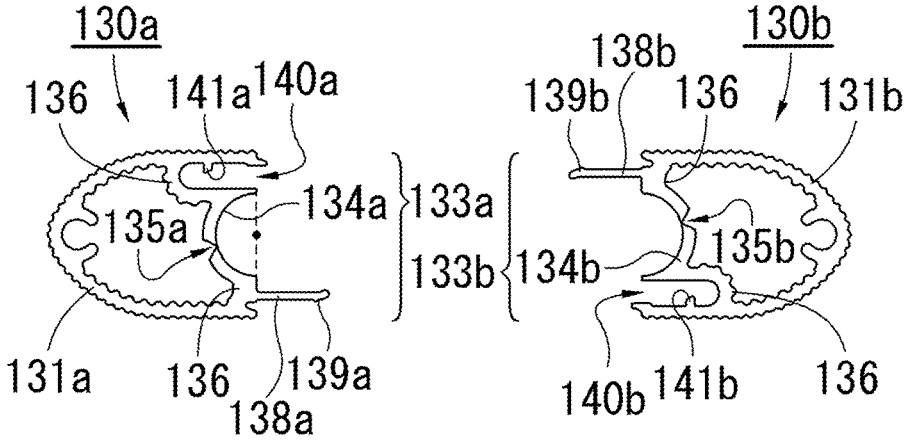

[ Fig. 5]
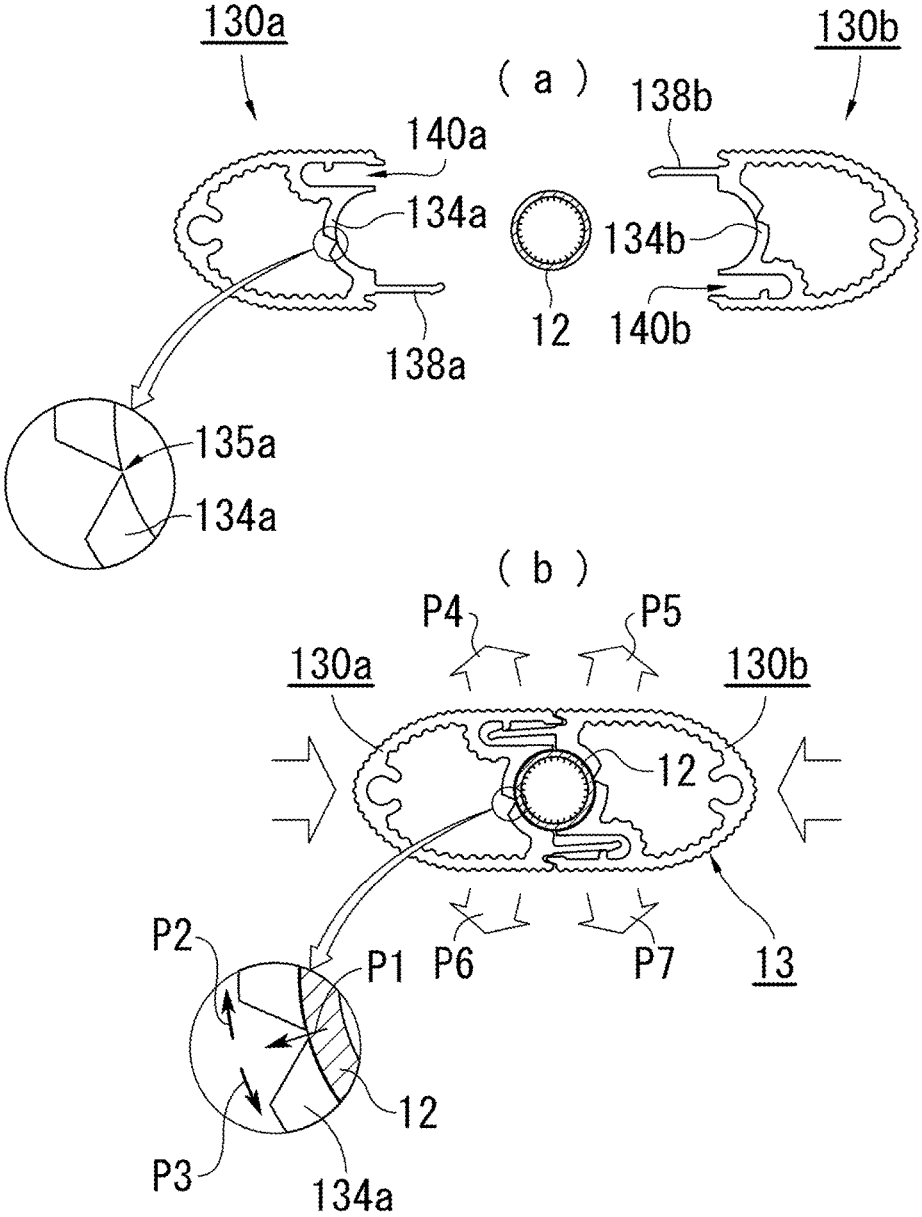

[ Fig. 6]
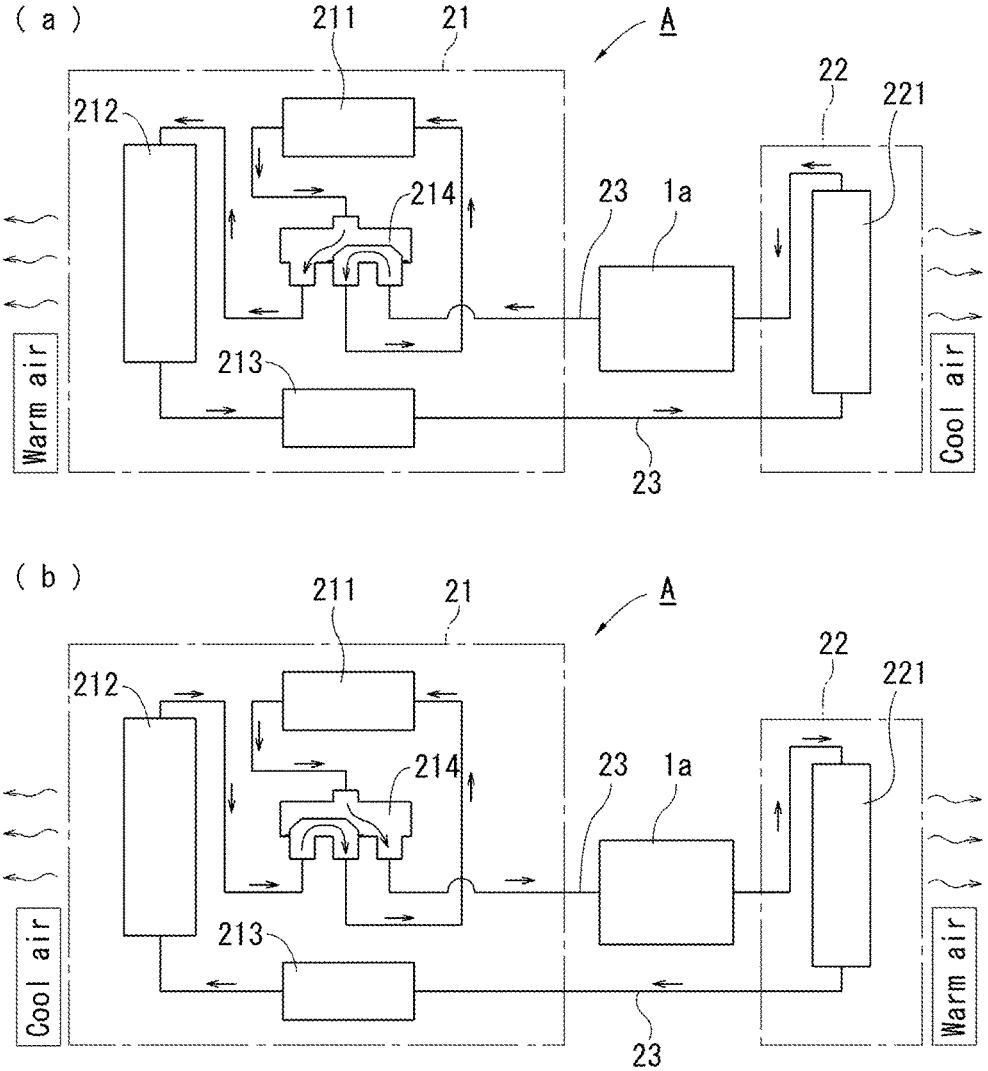

[ Fig. 7]
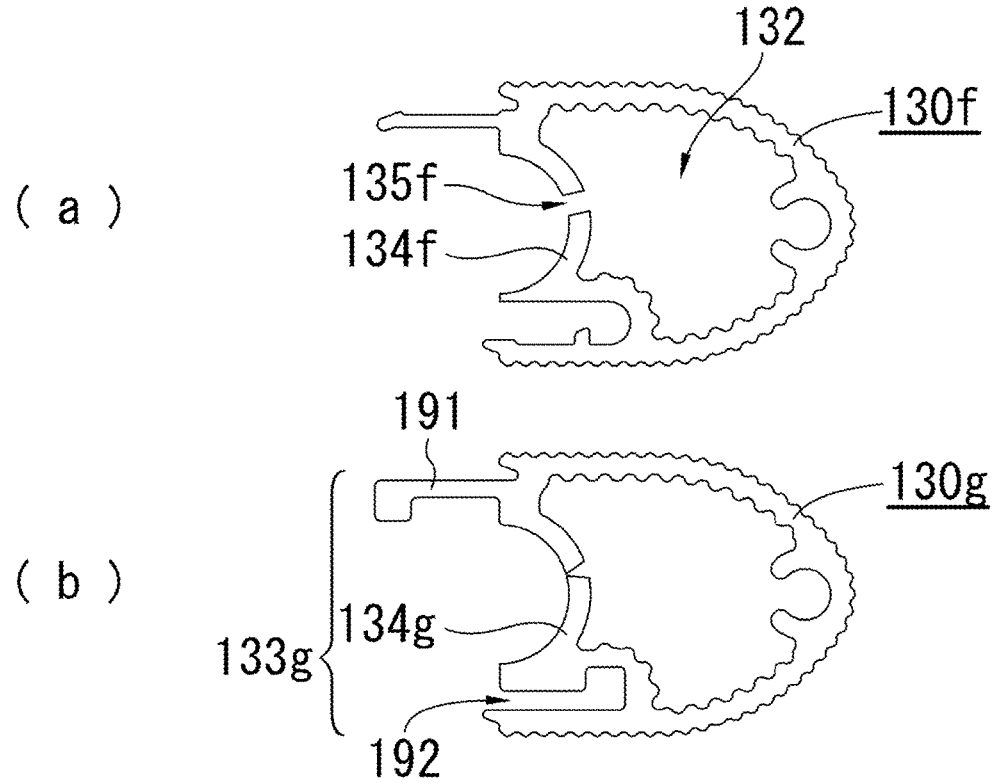

[ Fig. 8]
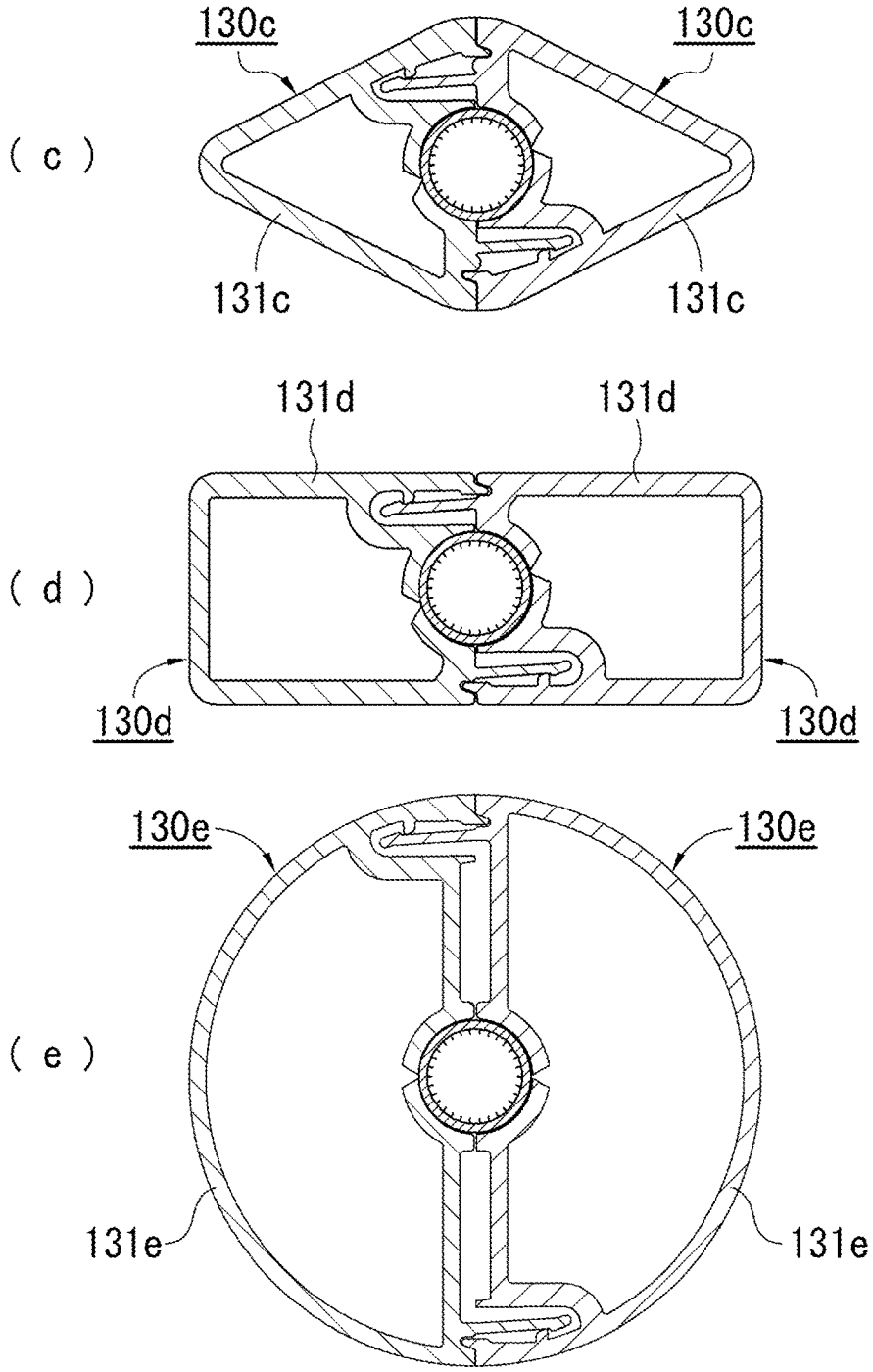

[ Fig. 9]
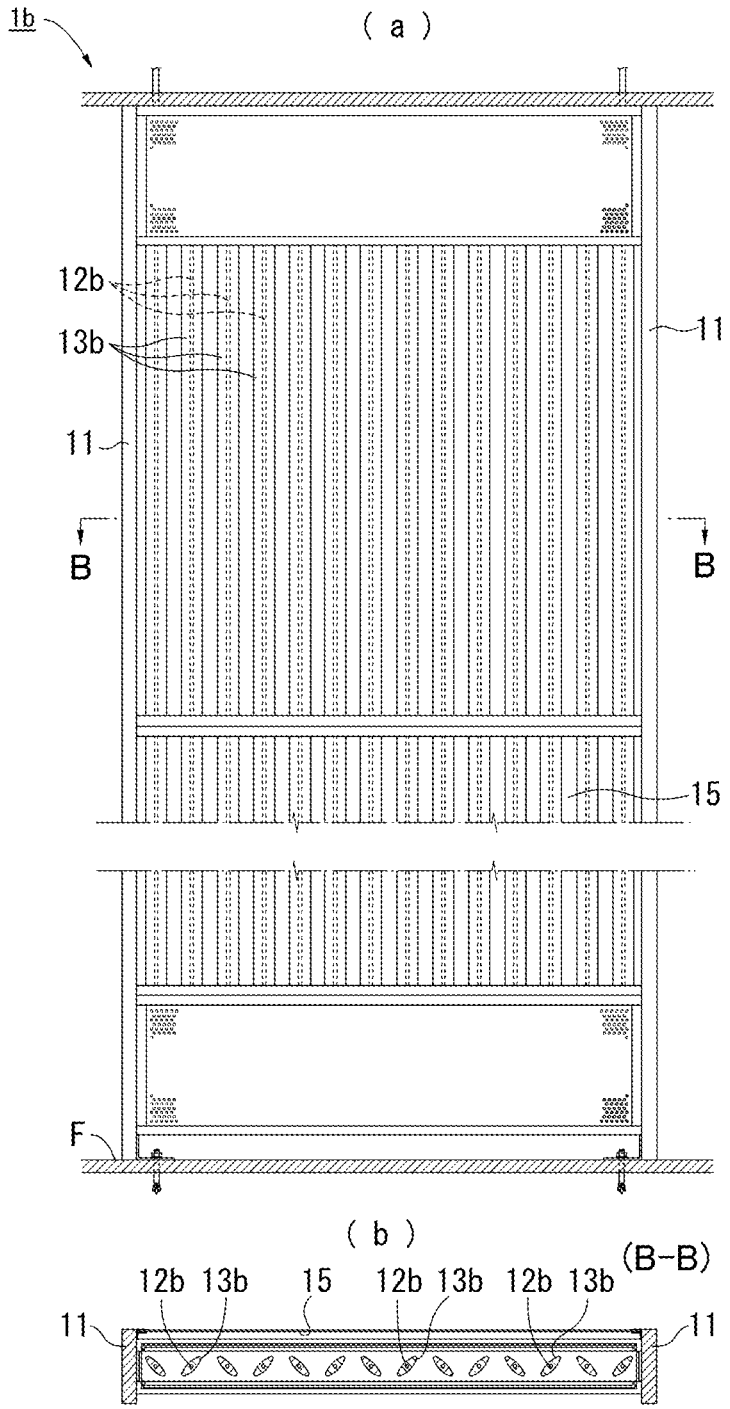

[ Fig. 10]
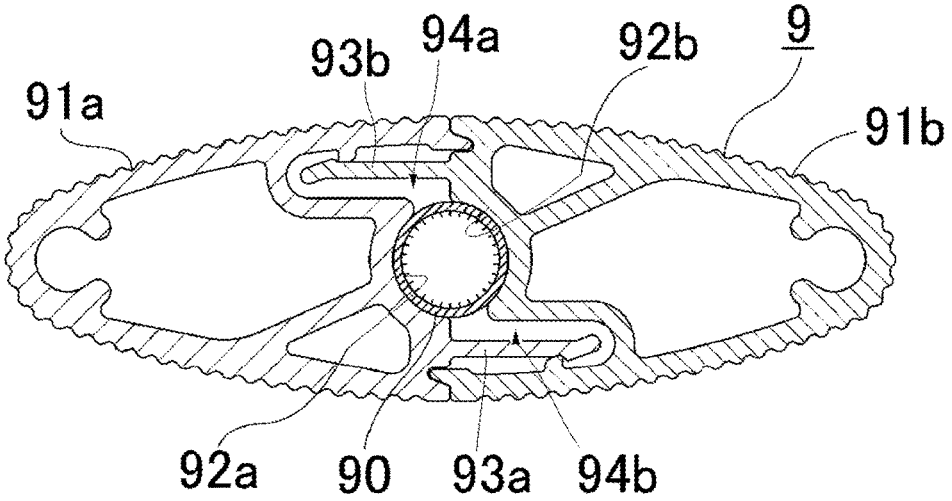

HEATING ELEMENT COVER COMPONENT, HEATING ELEMENT COVER, RADIANT COOLING AND HEATING APPARATUS, AND AIR CONDITIONING SYSTEM

CROSS REFERENCE TO RELATED APPLICATIONS

This patent application is a U.S. national stage application under 35 U.S.C. § 371 of International Patent Application No. PCT/JP2016/056366 filed on Mar. 2, 2016.

TECHNICAL FIELD

The present invention relates to a heating element cover component, a heating element cover, a radiant cooling and heating apparatus, and an air conditioning system. Specifically, the present invention relates to a heating element cover component for protecting a heating element of a radiant cooling and heating apparatus as well as having an excellent close-fitting property with a heating element disposed inside and excellent in thermal conductivity, and a heating element cover, a radiant cooling and heating apparatus, and an air conditioning system using the same heating element cover component.

BACKGROUND ART

Conventionally, various radiant cooling and heating apparatuses using radiant heat of heat exchangers have been proposed. Moreover, in each of the radiant cooling and heating apparatuses, various types of structures have been proposed for a cover that covers the heat exchanger part (hereinafter, referred to as a "heating element"). As an example of such a heating element cover of a radiant cooling and heating apparatus, one from the following Patent Document 1 as shown in FIG. 10 can be mentioned.

The heating element cover 9 (described as an "outer shell body" in the specification of Patent Document 1) shown in FIG. 10 has a pair of shell members 91*a* and 91*b* having the same shape as each other, and in the shell member 91*a*, an abutting portion 92*a* formed with a concave face to be joined so as to be closely fitted to an outer surface of a flow pipe 90 being the heating element, a projecting piece portion 93*a*, and a recess portion 94*a* are formed, and in the shell member 91*b*, an abutting portion 92*b* formed with a concave face to be joined so as to be closely fitted to the outer surface of the flow pipe 90, a projecting piece portion 93*b*, and a recess portion 94*b* are formed.

The shell members 91*a* and 91*b* have a structure in which the respective shell members 91*a* and 91*b* are fitted together with each other by inserting the projecting piece portion 93*a* into the recess portion 94*b* and inserting the projecting piece portion 93*b* into the recess portion 94*a* in a manner of sandwiching the flow pipe 90 with the abutting portions 92*a* and 92*b*.

As a result of having the construction described above, because the heating element cover 9 protects the flow pipe 90 and is a simple structure that can be assembled by only fitting together, no special tool or special technique is required for operation, which enables quick assembly. Also, because the shell members 91*a* and 91*b* are identical components, needless expense in component procurement can be eliminated to resultingly achieve a reduction in manufacturing costs.

PRIOR ART DOCUMENT

Patent Document

[Patent Document 1] Japanese Patent No. 5544580

SUMMARY OF THE INVENTION

Problem(s) to be Solved by the Invention

However, for the heating element cover 9, in actuality, an inner diameter formed by the abutting portions 92*a* and 92*b* is provided slightly larger than an outer diameter of the flow pipe 90, and for the resulting gap, an operation of applying or filling with a heat radiation grease has been performed. This is because, for closely fitting the abutting portions 92*a* and 92*b* and the flow pipe 90 in a manner not damaging the flow pipe 90 by a pressing force applied from the abutting portions 92*a* and 92*b*, a high processing accuracy becomes necessary for both of the abutting portions 92*a* and 92*b* and the flow pipe 90.

When a heat radiation grease is used, because a step of cleaning the surface of the flow pipe 90 followed by application or the like is required, the operation takes time and labor, and also, the heat radiation grease provided by the application or the like degrades to have a lower conductivity in some cases.

On the other hand, for heat from the flow pipe 90 to be transferred to the abutting portions 92*a* and 92*b* quickly with a small heat loss, it is optimal to adopt a structure in which the abutting portions 92*a* and 92*b* and the flow pipe 90 are closely fitted, and when this structure is realized, the rise time until radiant heat is radiated from the heating element cover 9 can also be shortened.

The present invention has been made in view of the above points, and an object thereof is to provide a heating element cover component for protecting a heating element of a radiant cooling and heating apparatus as well as having an excellent close-fitting property with a heating element disposed inside and excellent in thermal conductivity, and a heating element cover, a radiant cooling and heating apparatus, and an air conditioning system using the same heating element cover component.

Means for Solving the Problem(s)

In order to achieve the above object, a heating element cover component of the present invention includes a hollow outer shell portion of a required length, having required rigidity and thermal conductivity, a substantially half-pipe shaped abutting portion formed with a required thickness at a required site of the outside of the outer shell portion in parallel with a longitudinal direction of the outer shell portion, having flexibility and thermal conductivity, and with a slit penetrating in a thickness direction formed over the entire length in parallel with the longitudinal direction, a connecting portion having flexibility and thermal conductivity, connecting opposed edges of the abutting portion parallel to the longitudinal direction with the outer shell portion, and an engaging portion constituted by engaging elements that are disposed at line-symmetrical positions using a longitudinal straight line located at a widthwise middle of the abutting portion as an axis of symmetry to form a pair structured to be engageable with each other.

Here, the outer shell portion, as a result of having required rigidity, secures strength to such an extent that the heating element cover component is not easily deformed. Also, the outer shell portion, as a result of having thermal conductivity, can radiate heat transmitted from a heating element being covered and absorb heat from the outside (hereinafter, collectively referred to as "to exchange heat"). Further, because the outer shell portion is hollow, the member weight is reduced to reduce a load to be applied to the heating element being covered.

The abutting portion, as a result of having thermal conductivity, can exchange heat between a heating element being covered and the outer shell portion by abutting against the heating element. Also, the abutting portion, as a result of being a substantially half-pipe shaped abutting portion having flexibility and with a slit penetrating in a thickness direction formed over the entire length in parallel with the longitudinal direction, even if the heating element being covered has a thickness slightly larger than the abutting portions when sandwiching the heating element therebetween, can warp in a direction in which the slit expands in width to enclose the heating element in a manner not producing a gap between the heating element and the abutting portions.

As a result of the connecting portion having thermal conductivity and connecting the abutting portion and the outer shell portion, heat transfers between the heating element and the outer shell portion via the abutting portion. Further, the connecting portion, as a result of having flexibility, warps following an expanding motion of the abutting portion, and therefore assists the expanding motion of the abutting portion according to the thickness of the heating element.

The engaging portion, as a result of its engaging elements being constructed with the arrangement described above, allows assembling a heating element cover by making mutual joining portions face to face with another heating element cover component having the identical structure and engaging paired engaging elements.

Also, when the slit is formed in a shape that gradually narrows from a side of a hollow region in the outer shell portion to a direction of an outer surface of the abutting portion, by constructing the abutting portion to be partially thin only on the periphery of the slit without reducing the thickness thereof in whole, the abutting portion warps with the slit part as a start, and becomes likely to expand in a direction in which the abutting portion swells.

Additionally, for example, when a heating element cover component is manufactured by extruding, if a slit forming part of an extrusion die used is thread-like, it becomes likely that said part chips due to pressurization to pose a problem in durability of the extrusion die, but by providing the slit in the shape described above, a large slit forming part can be secured in the extrusion die, while the slit that is to appear at the outer surface side of the abutting portion can be prevented from becoming wide in width.

Also, when the outer shell portion, the abutting portion, the connecting portion, and the engaging portion are made of aluminum or made of an aluminum alloy, and an alumite processing is applied to an outer surface of the outer shell portion, the abutting portion, the connecting portion, and the engaging portion and an inner surface of the outer shell portion, corrosion resistance is improved by a formed film. Particularly, a film formed on the inner surface of the outer shell portion can improve resistance to corrosion caused by a temperature change or dew condensation that occurs in the hollow region in the outer shell portion. Additionally, a film formed on the outer surface of the outer shell portion, etc., can improve heat dissipation to increase the efficiency of heat exchange. Further, an alumite film formed on the abutting portion does not conduct electricity because of having insulating properties and thereby prevents the occurrence of electrolytic corrosion (galvanic corrosion) that possibly occurs when the heating element being an attaching target is a dissimilar metal such as copper.

Also, when one of the engaging elements is a projecting piece that projects in a direction opposite to the outer shell portion and is formed with a latching pawl, and the other of the engaging elements is a projecting piece inserting portion that is set to a size capable of receiving the projecting piece and is capable of latching the latching pawl, only making respective joining portions of a pair of heating element cover components face to face to be fitted together by inserting the projection piece of one heating element cover component into the projecting piece inserting portion of the other heating element cover component to latch the latching pawl and likewise inserting the projection piece of the other heating element cover component into the projecting piece inserting portion of the one heating element cover component to latch the latching pawl allows strongly and fixedly fixing the respective heating element cover components.

In this case, because the engaging elements have a simple structure of only fitting the projecting piece and the projecting piece inserting portion together, no special tool or special technique is required for an assembling operation to a heating element to be covered, which thus enables quick assembly.

In order to achieve the above object, a heating element cover of the present invention has a structure of a pair of heating element cover components, each including a hollow outer shell portion of a required length, having required rigidity and thermal conductivity, a substantially half-pipe shaped abutting portion formed with a required thickness at a required site of the outside of the outer shell portion in parallel with a longitudinal direction of the outer shell portion, having flexibility and thermal conductivity, and with a slit penetrating in a thickness direction formed over the entire length in parallel with the longitudinal direction, a connecting portion having flexibility and thermal conductivity, connecting opposed edges of the abutting portion parallel to the longitudinal direction with the outer shell portion, and an engaging portion constituted by engaging elements that are disposed at line-symmetrical positions using a longitudinal straight line located at a widthwise middle of the abutting portion as an axis of symmetry to form a pair structured to be engageable with each other, of which the engaging elements mutually paired are engaged with each other in a manner joining the abutting portions together with the engaging elements made face to face with each other.

Here, the outer shell portion, as a result of having required rigidity, secures strength to such an extent so as not to easily deform. Moreover, the outer shell portion prevents a heating element being covered from being deformed or damaged by an outside pressure or impact. Also, the outer shell portion, as a result of having thermal conductivity, can exchange heat with the heating element being covered. The surface area can thereby be made larger than when the heating element is directly exposed for use, and heat dissipation and heat absorption are improved to have an excellent heat exchange efficiency. Further, because the outer shell portion is hollow, the member weight is reduced to reduce a load to be applied to the heating element being covered.

The abutting portion, as a result of having thermal conductivity, can exchange heat between a heating element being covered and the outer shell portion by abutting against the heating element. Also, the abutting portion, as a result of being a substantially half-pipe shaped abutting portion having flexibility and with a slit penetrating in a thickness direction formed over the entire length in parallel with the longitudinal direction, even if the heating element being covered has a thickness slightly larger than the abutting portions when sandwiching the heating element therebetween, can warp in a direction in which the slit expands in width to enclose the heating element in a manner not producing a gap between the heating element and the abutting portions.

As a result of the connecting portion having thermal conductivity and connecting the abutting portion and the outer shell portion, heat transfers between the heating element and the outer shell portion via the abutting portion. Further, the connecting portion, as a result of having flexibility, warps following an expanding motion of the abutting portion, and assists the expanding motion of the abutting portion according to the thickness of the heating element.

The engaging portion, as a result of its engaging elements being constructed with the arrangement described above, allows assembling a heating element cover by making mutual joining portions face to face with another heating element cover component having the identical structure and engaging paired engaging elements.

Moreover, by engaging the engaging elements mutually paired, of the respective heating element cover components described above, with each other in a manner joining the abutting portions together with the engaging elements made face to face with each other, a heating element cover can be obtained. When the respective heating element cover components are joined into the heating element cover thus obtained, because the opposed ends of the respective abutting portions are also joined as a result of the respective engaging elements being present at the line-symmetrical positions described above, the heating element can be appropriately fitted.

Because the abutting portions and the heating element are consequently closely fitted and the abutting portions have no gap produced with the heating element, the heating element cover is improved in thermal conductivity and heat exchange efficiency. Further, the joined abutting portions are, even with their diameter being slightly smaller than that of the heating element, constructed so that the respective abutting portions can be deformed by warping to be closely fitted, and can therefore be attached, because of the construction described above, even with some errors, although a high processing accuracy has conventionally been required for closely fitting the abutting portions and the heating element.

Also, because this heating element cover has a pair of constituting heating element cover components being identical components, needless expense in component procurement can be eliminated to resultingly achieve a reduction in manufacturing costs.

In order to achieve the above object, a radiant cooling and heating apparatus according to the present invention includes a support frame, a heating element which is disposed in an in-between region sandwiched by the support frame or surrounded by the support frame, inside of which a flowable heating medium can flow through, and which consists of a plurality of tubular parts laid thereacross at an interval, and a heating element cover having a structure of a pair of heating element cover components installed for each of the tubular parts of the heating element, and each including a hollow outer shell portion of a required length, having required rigidity and thermal conductivity, a substantially half-pipe shaped abutting portion formed with a required thickness at a required site of the outside of the outer shell portion in parallel with a longitudinal direction of the outer shell portion, having flexibility and thermal conductivity, and with a slit penetrating in a thickness direction formed over the entire length in parallel with the longitudinal direction, a connecting portion having flexibility and thermal conductivity, connecting opposed edges of the abutting portion parallel to the longitudinal direction with the outer shell portion, and an engaging portion constituted by engaging elements that are disposed at line-symmetrical positions using a longitudinal straight line located at a widthwise middle of the abutting portion as an axis of symmetry to form a pair structured to be engageable with each other, of which the abutting portions are made mutually face to face with each other to sandwich each tubular part of the heating element therebetween, and the engaging elements mutually paired are engaged with each other with the engaging elements made face to face with each other.

Here, the support frame supports the heating element and the heating element cover at a required interval. Also, the heating element, as a result of a flowable heating medium flowing through the inside thereof, transmits heat to the heating element cover that is in contact with its tubular parts.

The outer shell portion of the heating element cover, as a result of having required rigidity, secures strength to such an extent so as not to easily deform, and prevents the heating element from being deformed or damaged by an outside pressure or impact. Also, the outer shell portion, as a result of having thermal conductivity, can exchange heat by, for example, radiating heat transmitted from the heating element to the surroundings. The surface area can thereby be made larger than when the heating element is directly exposed for use, and heat dissipation and heat absorption are improved to have an excellent heat exchange efficiency. Further, because the outer shell portion is hollow, the member weight is reduced to reduce a load to be applied to the heating element and the support frame.

The abutting portion of the heating element cover, as a result of having thermal conductivity, can exchange heat between an abutted heating element and the outer shell portion. Also, the abutting portion, as a result of being a substantially half-pipe shaped abutting portion having flexibility and with a slit penetrating in a thickness direction formed over the entire length in parallel with the longitudinal direction, even if the tubular part of the heating element has a thickness slightly larger than the abutting portions when sandwiching the heating element therebetween, can warp in a direction in which the slit expands in width to enclose the heating element in a manner not producing a gap between the heating element and the abutting portions.

As a result of the connecting portion of the heating element cover having thermal conductivity and connecting the abutting portion and the outer shell portion, heat transfers between the heating element and the outer shell portion via the abutting portion. Further, the connecting portion, as a result of having flexibility, warps following an expanding motion of the abutting portion, and assists the expanding motion of the abutting portion according to the thickness of the heating element.

The engaging portion of the heating element cover, as a result of its engaging elements being constructed with the arrangement described above, allows assembling a heating element cover by making mutual joining portions face to face with another heating element cover component having the identical structure and engaging paired engaging elements.

The radiant cooling and heating apparatus allows assembling a heating element cover by engaging the engaging elements mutually paired, of the respective heating element cover components described above, with each other in a manner joining the abutting portions together with the engaging elements made face to face with each other. When the respective heating element cover components are joined into the heating element cover thus obtained, because the opposed ends of the respective abutting portions are also joined as a result of the respective engaging elements being present at the line-symmetrical positions described above, the heating element can be appropriately fitted.

Because the abutting portions and the heating element are consequently closely fitted and the abutting portions have no gap produced with the heating element, the heating element cover is improved in thermal conductivity and heat exchange efficiency. Further, the joined abutting portions are, even with their diameter being slightly smaller than that of the heating element, constructed so that the respective abutting portions can be deformed by warping to be closely fitted, and can therefore be attached, because of the construction described above, even with some errors, although a high processing accuracy has conventionally been required for closely fitting the abutting portions and the heating element.

Also, because this heating element cover has a pair of constituting heating element cover components being identical components, needless expense in component procurement can be eliminated to resultingly achieve a reduction in manufacturing costs.

With the radiant cooling and heating apparatus, during operation, a person in the surrounding area never feels an uncomfortable draft sensation, and air heated or cooled by the heating element cover directly warms or cools a space in front thereof, and can efficiently warm and cool the installation space because convection occurs in the installation space.

In order to achieve the above object, an air conditioning system of the present invention includes a radiant cooling and heating apparatus including a support frame, a heating element which is disposed in an in-between region sandwiched by the support frame or surrounded by the support frame, inside of which a flowable heating medium can flow through, and which consists of a plurality of tubular parts laid thereacross at an interval, a heating element cover having a structure of a pair of heating element cover components installed for each of the tubular parts of the heating element, and each including a hollow outer shell portion of a required length, having required rigidity and thermal conductivity, a substantially half-pipe shaped abutting portion formed with a required thickness at a required site of the outside of the outer shell portion in parallel with a longitudinal direction of the outer shell portion, having flexibility and thermal conductivity, and with a slit penetrating in a thickness direction formed over the entire length in parallel with the longitudinal direction, a connecting portion having flexibility and thermal conductivity, connecting opposed edges of the abutting portion parallel to the longitudinal direction with the outer shell portion, and an engaging portion constituted by engaging elements that are disposed at line-symmetrical positions using a longitudinal straight line located at a widthwise middle of the abutting portion as an axis of symmetry to form a pair structured to be engageable with each other, of which the abutting portions are made mutually face to face with each other to sandwich each tubular part of the heating element therebetween, and the engaging elements mutually paired are engaged with each other with the engaging elements made face to face with each other, and an air conditioner to be operated in combination with the radiant cooling and heating apparatus, including a refrigerant circuit in which a compressor, an expansion valve, a flow path switching valve, an indoor side heat exchanger, and an outdoor side heat exchanger are connected by piping to circulate a refrigerant to perform a refrigeration cycle, said radiant cooling and heating apparatus being incorporated in said refrigerant circuit, and supplying air that has undergone heat exchange with the refrigerant by the indoor side heat exchanger to an indoor space by a fan.

Here, the support frame of the radiant cooling and heating apparatus supports the heating element and the heating element cover at a required interval. Also, the heating element of the radiant cooling and heating apparatus, as a result of a refrigerant supplied from the air conditioner flowing through the inside thereof, transmits heat to the heating element cover that is in contact with its tubular parts.

The outer shell portion of the heating element cover, as a result of having required rigidity, secures strength to such an extent so as not to easily deform, and prevents the heating element from being deformed or damaged by an outside pressure or impact. Also, the outer shell portion, as a result of having thermal conductivity, can exchange heat by, for example, radiating heat transmitted from the heating element to the surroundings. The surface area can thereby be made larger than when the heating element is directly exposed for use, and heat dissipation and heat absorption are improved to have an excellent heat exchange efficiency. Further, because the outer shell portion is hollow, the member weight is reduced to reduce a load to be applied to the heating element and the support frame.

The abutting portion of the heating element cover, as a result of having thermal conductivity, can exchange heat between an abutted heating element and the outer shell portion. Also, the abutting portion, as a result of being a substantially half-pipe shaped abutting portion having flexibility and with a slit penetrating in a thickness direction formed over the entire length in parallel with the longitudinal direction, even if the tubular part of the heating element has a thickness slightly larger than the abutting portions when sandwiching the heating element therebetween, can warp in a direction in which the slit expands in width to enclose the heating element in a manner not producing a gap between the heating element and the abutting portions.

As a result of the connecting portion of the heating element cover having thermal conductivity and connecting the abutting portion and the outer shell portion, heat transfers between the heating element and the outer shell portion via the abutting portion. Further, the connecting portion, as a result of having flexibility, warps following an expanding motion of the abutting portion, and assists the expanding motion of the abutting portion according to the thickness of the heating element.

The engaging portion of the heating element cover, as a result of its engaging elements being constructed with the arrangement described above, allows assembling a heating element cover by making mutual joining portions face to face with another heating element cover component having the identical structure and engaging paired engaging elements.

The air conditioner, as a result of being one including a refrigerant circuit in which a compressor, an expansion valve, a flow path switching valve, an indoor side heat exchanger, and an outdoor side heat exchanger are connected by piping to circulate a refrigerant to perform a refrigeration cycle and supplying air that has undergone heat exchange with the refrigerant by the indoor side heat exchanger to an indoor space by a fan, can perform air conditioning of the interior of the installation space by forced convection due to blown air.

The radiant cooling and heating apparatus allows assembling a heating element cover by engaging the engaging elements mutually paired, of the respective heating element cover components described above, with each other in a manner joining the abutting portions together with the engaging elements made face to face with each other. When the respective heating element cover components are joined into the heating element cover thus obtained, because the opposed ends of the respective abutting portions are also joined as a result of the respective engaging elements being present at the line-symmetrical positions described above, the heating element can be appropriately fitted.

Because the abutting portions and the heating element are consequently closely fitted and the abutting portions have no gap produced with the heating element, the heating element cover is improved in thermal conductivity and heat exchange efficiency. Further, the joined abutting portions are, even with their diameter being slightly smaller than that of the heating element, constructed so that the respective abutting portions can be deformed by warping to be closely fitted, and can therefore be attached, because of the construction described above, even with some errors, although a high processing accuracy has conventionally been required for closely fitting the abutting portions and the heating element.

Also, because this heating element cover has a pair of constituting heating element cover components being identical components, needless expense in component procurement can be eliminated to resultingly achieve a reduction in manufacturing costs.

Additionally, because the radiant cooling and heating apparatus, as a result of being incorporated in the refrigerant circuit of the air conditioner, is supplied with a refrigerant from the air conditioner side, equipment such as a compressor becomes no longer necessary for the radiant cooling and heating apparatus, and it also becomes possible to perform control coupled with the air conditioner.

Further, with the radiant cooling and heating apparatus, during operation, a person in the surrounding area never feels an uncomfortable draft sensation, and air heated or cooled by the heating element cover directly warms or cools a space in front thereof, and can efficiently warm and cool the installation space because convection occurs in the interior of the installation space.

The air conditioning system described above, by operating the radiant cooling and heating apparatus and the air conditioner in combination, enables approaching a target temperature in a short time by mainly operating the air conditioner at start-up, and thereafter by mainly operating the radiant cooling and heating apparatus, enables maintaining the temperature of the interior of the installation space, and the fan operating time of the indoor heat exchanger can be held short to perform air conditioning that does not provide an uncomfortable draft sensation to the human body.

Also, when the radiant cooling and heating apparatus and the air conditioner are simultaneously operated, radiant heat from the radiant cooling and heating apparatus acts directly on the body sensation of a person that is present in the vicinity, while the air conditioner performs air conditioning of the entirety, and therefore, the time until comfort is provided for the person in the surrounding area can be made shorter than when either the air conditioner or the radiant cooling and heating apparatus is operated alone. Further, convecting the radiant heat from the radiant cooling and heating apparatus and blown air from the fan allows quickly making the temperature of the interior of the installation space uniform.

Effects of the Invention

The heating element cover component according to the present invention can provide one for protecting a heating element of a radiant cooling and heating apparatus as well as having an excellent close-fitting property with a heating element disposed inside and excellent in thermal conductivity.

The heating element cover according to the present invention can provide one for protecting a heating element of a radiant cooling and heating apparatus as well as having an excellent close-fitting property with a heating element disposed inside and excellent in thermal conductivity.

The radiant cooling and heating apparatus according to the present invention can provide one for protecting its heating element as well as having an excellent close-fitting property with a heating element disposed inside and excellent in thermal conductivity.

The air conditioning system according to the present invention can provide one for protecting a heating element of a radiant cooling and heating apparatus incorporated in the air conditioning system as well as having an excellent close-fitting property with a heating element disposed inside and excellent in thermal conductivity.

BRIEF DESCRIPTION OF THE DRAWINGS

FIG. 1 is a schematic explanatory view of an air conditioning system of the present invention.

FIG. 2(*a*) is a front view of a radiant cooling and heating apparatus being a constituent of the air conditioning system shown in FIG. 1, and FIG. 2(*b*) is a sectional view taken along A-A of the radiant cooling and heating apparatus shown in FIG. 2(*a*).

FIG. 3 is a perspective explanatory view of a pair of heating element cover components that constitute a heating element cover of the radiant cooling and heating apparatus shown in FIG. 2.

FIG. 4 is a front view of the heating element cover components shown in FIG. 3.

FIG. 5 shows a heating element cover before and after assembly using the heating element cover components shown in FIG. 3 and shows the vicinity of a slit in an enlarged manner, in which FIG. 5(*a*) is a front explanatory view before assembly, and FIG. 5(*b*) is a front explanatory view after assembly.

FIG. 6 includes refrigerant circuit diagrams of the air conditioning system shown in FIG. 1, in which FIG. 6(*a*) is of during cooling, and FIG. 6(*b*) is of during heating.

FIG. 7 shows modifications of the heating element cover component of the present invention, in which FIG. 7(*a*) is a front explanatory view enlarged in part of a modification in an abutting portion, and FIG. 7(*b*) is a front explanatory view of a modification in an engaging portion.

FIG. 8 shows modifications of the heating element cover component of the present invention, in which FIG. 8(*c*), FIG. 8(*d*), and FIG. 8(*e*) are all front explanatory views of modifications in an outer shell portion.

FIG. 9 shows a modification of the radiant cooling and heating apparatus of the present invention across which heating element covers are laid longitudinally, in which FIG. 9(*a*) is a front view thereof, and FIG. 9(*b*) is a sectional view taken along B-B thereof.

FIG. 10 is a perspective view showing a structure of a conventional heating element cover.

MODES FOR CARRYING OUT THE INVENTION

Embodiments of the present invention will be described in greater detail with reference to FIG. 1 to FIG. 9. In addition, symbols in the respective figures are used so as to reduce complication and facilitate understanding. In addition, a term "horizontal part" (of a heating element) to be described later is used with a meaning equal to the "tubular part" described earlier, and a term "space" (of an outer shell portion) to be described later is used with a meaning equal to the "hollow region in the outer shell portion" described earlier. Further, a "joining portion" to be described later is used with a meaning collectively referring to a section made up of the "abutting portion," the "connecting portion," and the "engaging portion" described above.

An air conditioning system A shown in FIG. 1 and FIG. 6 includes a radiant cooling and heating apparatus 1*a* and an air conditioner 2 including an outdoor machine 21 and a convective indoor machine 22, and the respective portions will be described in the following.

[Radiant Cooling and Heating Apparatus 1*a*]

FIG. 2(*a*) and FIG. 2(*b*) are referred to. The radiant cooling and heating apparatus 1*a* has a support frame 11, a heating element 12, heating element covers 13, a reflector 15, a water receiving portion 16, and a panel body 17.

(Support Frame 11)

The support frame 11 has support portions 110 provided to stand on an installation surface F (if indoors, a floor surface or the like) of the radiant cooling and heating apparatus 1*a* and disposed at an interval in the horizontal direction. The respective support portions 110 store inside connecting parts located at both ends of the heating element 12 to be described later in a manner not visible from the outside (refer to FIG. 2(*a*)).

(Heating Element 12)

The heating element 12 is a copper-made tubular body through the inside of which a refrigerant can flow, and is disposed in a region between the support portions 110 of the support frame 11. The heating element 12 has a structure, in a manner connecting at both end sides, meandering in an up-and-down direction so as to run as a whole along an identical vertical plane, in which heating element covers 13 are respectively mounted on respective horizontal parts arranged at regular intervals. Connecting portions 181 and 182 are provided over and under the radiant cooling and heating apparatus 1*a*, respectively, and these are connecting parts to an inlet pipe or return pipe of a refrigerant that flows to or from the heating element 12.

Each horizontal part of the heating element 12 is formed with an outer diameter of its cross-section that is substantially the same as or slightly larger than an inner diameter of a region being circular in cross-section constituted by an abutting portion 134*a* and an abutting portion 134*b* when heating element cover components 130*a* and 130*b* are fitted to each other. In greater detail, the outer diameter of each horizontal part of the heating element 12 has a numerical value of 105 when the numerical value of the inner diameter of a circular region constituted by the abutting portion 134*a* and the abutting portion 134*b* is provided as 100.

(Heating Element Cover 13)

FIG. 3, FIG. 4, and FIG. 5 are referred to. The heating element cover 13 covers the heating element 12, and has a structure capable of dissipating to the outside heat transmitted from the heating element 12. The heating element cover 13 having a required length is constituted by a combination of a pair of heating element cover components 130*a* and 130*b* having the same shape as each other. The heating element cover components 130*a* and 130*b* when fitted together have an outer shape of a cross-section being a slightly flat, substantially elliptical shape (refer to FIG. 5(*b*)).

The respective heating element covers 13 are attached to the support frame 11 in a manner such that long axis directions of their cross-sections are similarly downwardly inclined toward the reflector 15 (refer to FIG. 2(*b*)). An inclination angle when attaching the respective heating element covers 13 to the support frame 11 is 45° where the angle at which the long axis of an elliptical sectional shape of the heating element cover 13 becomes horizontal is provided as 0°.

The heating element cover components 130*a* and 130*b* are made of an aluminum alloy having required rigidity and thermal conductivity, and are manufactured by extrusion molding and cut at a required length to be used. In addition, the heating element cover components 130*a* and 130*b* are the same in structure as each other, and therefore, the heating element cover components 130*a* will be described by way of example in the following.

(Heating Element Cover Component 130*a*)

The heating element cover component 130*a* has an outer shape of a cross-section being a slightly flat, substantially semielliptical shape divided in a short diameter direction as viewed in end elevation, and is made up of an outer shell portion 131*a* and a joining portion 133*a*. An outer surface of the outer shell portion 131*a* and the joining portion 133*a* and an inner surface of the outer shell portion 131*a* (inner wall of a space 132 to be described later) are applied with an alumite processing.

The outer shell portion 131*a* has a space 132 that continues longitudinally at the inner side. Moreover, the outer shell portion 131*a* is applied across its entire outer surface and an inner wall of the space 132 excluding the side of a rear surface of the abutting portion 134*a* with knurling that forms longitudinally extending concavities and convexities. The outer shell portion 131*a* is slightly thick-walled in the vicinity of a projecting piece inserting portion 140*a* to be described later so as to have flexibility, but other parts are formed with a wall thickness that enables securing required rigidity.

The joining portion 133*a* is made up of the abutting portion 134*a* provided with a slit 135*a*, connecting portions 136, and an engaging portion having a projecting piece 138*a* and a projecting piece inserting portion 140*a* that are engaging elements.

The abutting portion 134*a* has a substantially half-pipe shape, and is semicircular as viewed in end elevation. The abutting portion 134*a* is provided at a required site of the outside of the outer shell portion 131*a* in parallel with the longitudinal direction, and its opposed edges parallel to the longitudinal direction are connected with the outer shell portion 131*a* by the connecting portions 136 formed with a wall thickness to have flexibility.

The abutting portion 134*a* has, at a middle portion in its arc direction, a slit 135*a* that is provided penetrating in its thickness direction over the entire length in parallel with the longitudinal direction and that connects to the space 132.

The slit 135*a* is formed in a shape (substantially wedge shape in cross-section) that gradually narrows from the side of the space 132 being its outer peripheral side to the direction of an inner peripheral side of the abutting portion 134*a*. Moreover, the slit 135*a* is formed so as to appear with a width on the order of 0.5 mm to 1 mm at the side of an inner peripheral surface of the abutting portion 134*a* (side to abut against the heating element 12).

The projecting piece 138*a* and the projecting piece inserting portion 140*a* are disposed at line-symmetrical positions using a longitudinal straight line located at a widthwise middle of the abutting portion 134*a* as an axis of symmetry (point located at the center of the broken line of FIG. 4), and form a pair structured to be engageable with each other.

The projecting piece 138*a* projects from one connecting portion 136 to the side opposite to the outer shell portion 131*a*, and is provided near its front end with a latching pawl 139*a*. The projecting piece inserting portion 140*a* has an internal space of a size capable of receiving the projecting piece 138*a*, and is provided, on an inner wall of the internal space, with a latching pawl retaining portion 141*a* being a projection portion capable of latching the latching pawl. In addition, the latching pawl retaining portion 141*a* latches a latching pawl 139*b* of the heating element cover component 130*b* being a combination target.

Although, in FIG. 4, etc., the respective portions of the heating element cover component 130*b* are the same in structure as those of the heating element cover component 130*a* and individual descriptions thereof will therefore be omitted, the outer shell portion 131*b* corresponds to the outer shell portion 131*a* to have the same structure, the joining portion 133*b* to the joining portion 133*a*, the abutting portion 134*b* to the abutting portion 134*a*, the slit 135*b* to the slit 135*a*, the projecting piece 138*b* to the projecting piece 138*a*, the latching pawl 139*b* to the latching pawl 139*a*, the projecting piece inserting portion 140*b* to the projecting piece inserting portion 140*a*, and the latching pawl retaining portion 141*b* to the latching pawl retaining portion 141*a*, respectively.

(Reflector 15)

The reflector 15 is formed of a heat insulating material, and has a reflecting surface 151 that is not permeable to water, and the reflecting surface 151 is disposed so as to be opposed at an interval to an end edge portion at a lower side in the long axis direction of the heating element cover 13. To a lower end of the reflector 15, a guide plate 152 bent at an obtuse angle to the side of the heating element cover 13 is attached. A front end of the guide plate 152 is structured to be located in the inside of the water receiving portion 16 to be described later.

(Water Receiving Portion 16)

The water receiving portion 16 is located below the lowermost one among the heating element covers 13 and under the reflector 15 (more specifically, under a guide plate 152 attached to the reflector 15), and is in a gutter shape opened at an upper part.

(Panel Body 17)

The panel body 17 is formed of a perforated metal, and attached to below the front side of the radiant cooling and heating apparatus 1*a*. The panel body 17 provides a covering for the water receiving portion 16, a piping portion (not shown), etc., so as to serve as a screen when viewed from the front direction. Also, the panel body 17 is attached so that a clearance for ventilation is formed with the installation surface F.

[Air Conditioner 2]

As shown in FIG. 1, for the air conditioner 2, the outdoor machine 21 and the general convective indoor machine 22 connected therein are connected by refrigerant piping 23. On a pathway between the outdoor machine 21 and the convective indoor machine 22, the radiant cooling and heating apparatus 1*a* is communicatively connected in series. Accordingly, the radiant cooling and heating apparatus 1*a* and the convective indoor machine 22 installed in a room or the like having an air conditioning target space form a part of a refrigerant circuit, and a cooling operation or heating operation can be performed in the air conditioning target space by circulating a refrigerant in the refrigerant circuit.

As shown in FIG. 6, the outdoor machine 21 has a publicly known structure having a compressor 211, an outdoor side heat exchanger 212, an expansion valve 213, and a four-way switching valve 214, and the convective indoor machine 22 has a publicly known structure including an indoor side heat exchanger 221 and a blowing fan (not shown). This equipment constitutes a so-called blow type air conditioner, and in the following, is sometimes collectively called simply an "air conditioner" when describing actions.

The indoor side heat exchanger 221 serves as a vaporizer during a cooling operation and as a condenser (radiator) during a heating operation, performs heat exchange between air supplied from the blowing fan or the like and the refrigerant, and generates heating air or cooling air to be supplied to the air conditioning target space. The equipment described above is connected via the refrigerant piping 23, and constitutes apart of a refrigeration cycle (refrigerant circuit) of the air conditioning system A.

(Action)

Actions of the air conditioning system A will be described with reference to FIG. 1 to FIG. 6.

(Method for Assembling Heating Element Cover 13)

FIG. 5 is referred to. As shown in FIG. 5(*a*), the joining portions 133*a* and 133*b* of the heating element cover components 130*a* and 130*b* are made face to face, and the projecting piece 138*a* is located directly opposite the projecting piece inserting portion 140*b* and the projecting piece 138*b* is located directly opposite the projecting piece inserting portion 140*a*, and the heating element 12 is disposed in a manner sandwiched between the abutting portions 134*a* and 134*b*. At this time, the slits 135*a* and 135*b* have not yet been expanded.

Then, as shown in FIG. 5(*b*), the heating element cover components 130*a* and 130*b* are fitted to each other. At this time, because the outer shape of a cross-section of the horizontal part of the heating element 12 has a diameter slightly larger than the inner diameter of the circular region constituted by the abutting portions 134*a* and 134*b*, a force to be applied in the direction of P1 is generated when the heating element 12 is fitted in the abutting portion 134*a* (134*b*) (although a partially enlarged view of the abutting portion 134*b* is omitted, the same action as in the partially enlarged view of the abutting portion 134*a* occurs).

The abutting portion 134*a* (134*b*) warps due to the force applied in the direction of P1 and expands in the direction of P2 and P3, and a force is also applied in the direction of P4 to P7 to warp the connecting portions 136 and the outer shell portion 131*a* (131*b*) in part, as well. The heating element cover components 130*a* and 130*b* can thereby be attached to the horizontal part of the heating element 12, and after the attachment, the heating element 12 and the heating element cover components 130*a* and 130*b* are closely fitted and kept so as to be immovable.

When the heating element cover components 130*a* and 130*b* are joined, because the opposed ends of the arc forms (semicircular forms) of the abutting portions 134*a* and 134*b* are also joined as a result of the projecting piece 138*a* and the projecting piece inserting portion 140*b* and the projecting piece 138*b* and the projecting piece inserting portion 140*a*, which are respectively engaging elements, being present at the aforementioned line-symmetrical positions, the heating element cover 13 thus attached can be appropriately fitted over the circular pipe-shaped heating element 12.

Also, because the slits 135*a* and 135*b* are formed in substantially wedge shapes in cross-section as described above, the abutting portions 134*a* and 134*b* are constructed to be partially thin only on the periphery of the slit without reducing the thickness thereof in whole, and the abutting portions 134*a* and 134*b* warp with the slit part as a start to become likely to expand in a direction in which each abutting portion swells.

Because the abutting portions 134*a* and 134*b* and the heating element 12 are consequently closely fitted and the abutting portions 134*a* and 134*b* have no gap produced with the heating element 12, the thermal conductivity and heat exchange efficiency are improved. Further, the abutting portions 134*a* and 134*b* are, even with their diameter being slightly smaller than that of the heating element 12, constructed so that the respective abutting portions can be deformed by warping to be closely fitted, and can therefore be attached, because of the construction described above, even with some errors, although a high processing accuracy has conventionally been required for closely fitting the abutting portions and the heating element.

An alumite film formed on the abutting portions 134*a* and 134*b* does not conduct electricity because of having insulating properties, and prevents the occurrence of electrolytic corrosion (galvanic corrosion) caused by a difference in material between the abutting portions and the heating element. In such a case of a combination of dissimilar metals, it is preferable in view of preventing the occurrence of electrolytic corrosion that an anticorrosion film is formed on at least the abutting portions 134*a* and 134*b*. In addition, because electrolytic corrosion does not occur or is unlikely to occur, for example, when the heating element is made of the same aluminum alloy, it is also optionally possible not to perform an alumite processing or the like.

According to the structure of this heating element cover 13, because the heating element cover components 130*a* (130*b*) being constituting components are identical, needless expense in component procurement can be eliminated to resultingly achieve a reduction in manufacturing costs.

Because the heating element cover 13 has the structure described above and is simply formed by only fitting the heating element cover components 130*a* (130*b*) together, no special tool or special technique is required for an assembling operation to the heating element 12, which thus enables quick assembly.

(Action of Radiant Cooling and Heating Apparatus 1*a*)

When a refrigerant flows into the radiant cooling and heating apparatus 1*a* from the side of the air conditioner 2, the refrigerant flows within the heating element 12. Then, heat of the refrigerant is conducted from the heating element 12 to the abutting portions 134*a* and 134*b*, and subsequently, the heat is conducted to the outer shell portion 131*a*, 131*b* via the connecting portions 136. Further, radiant heat from the abutting portions 134*a* and 134*b* is also conducted to the outer shell portion 131*a*, 131*b* through the space 132.

The heating element cover 13 thus radiates radiant heat to the outside. Of the radiant heat from the heating element cover 13, a portion generated from a side disposed on the front side of the radiant cooling and heating apparatus 1*a* is directly radiated to the front direction side of the radiant cooling and heating apparatus 1*a*, and a portion generated from a side disposed on the back side is reflected by the reflecting surface 151 of the reflector 15, and radiated to the front direction side of the radiant cooling and heating apparatus 1*a* through clearance gaps between the respective heating element covers 13. Also, because the attaching angle of the heating element cover 13 is 45°, a radiation flux generated from the side to be a front side of the heating element cover 13 is likely to head for the front side of the radiant cooling and heating apparatus 1*a* and a front-side floor surface, and can directly provide either cool or warm radiant heat to a person present on the front side of the radiant cooling and heating apparatus 1*a*.

The heating element cover 13 prevents the heating element 12 from being deformed or damaged by an outside pressure or impact. Moreover, the heating element cover 13 makes the surface area where radiant heat is generated larger than when the heating element 12 dissipates heat alone, and also improves the heat exchange efficiency. Further, also when heat is absorbed, the surface area is made larger than when the heating element 12 absorbs heat alone, and the heat exchange efficiency is therefore improved. In addition, the thermal conduction pathway when absorbing heat is opposite (heading for the heating element from the outer shell portions) to that of the heat dissipation described above.

Also, as a result of the heating element cover 13 being attached in an inclined manner as described above, when dew condensation water is produced on the surface of the heating element cover 13 during a cooling operation, the dew condensation water flows down only to the side of the reflector 15. Then, the dew condensation water (not shown) adhered to the reflecting surface 151 runs down the plate surface to flow down onto the water receiving portion 16 located below. Further, the dew condensation water does not splatter onto the front side of the radiant cooling and heating apparatus 1*a* even if dripping onto the heating element cover 13 located at a lower height because the heating element cover 13 is inclined to the side of the reflector 15 as described above.

Additionally, the water receiving portion 16 changes the direction of convection to guide cold air so as to flow to the front side of the radiant cooling and heating apparatus 1*a* to thereby prevent dew condensation from being produced on the installation surface F as a result of cold air that is convecting from an up-to-down direction during cooling directly contacting the installation surface F.

During a cooling or heating operation, a mainstream of air to rise or fall along the reflecting surface 151 occurs, and air passing through the clearance gaps of the respective heating element covers 13 flows to join the mainstream of air or flows separately therefrom. At this time of the joint flow or separate flow, the respective inclined heating element covers 13 guide air so as to easily flow to increase the flow speed of air passing through the clearance gaps. Further, during heating, radiant heat generated by the part to be at the front side of the respective heating element covers 13 warms the floor surface present in its radiation flux direction to enhance an upward convection effect of indoor air thereby caused.

With the radiant cooling and heating apparatus 1*a*, during operation, because the flow of air that is generated in the space of an installation region is thus by natural convection due to a difference in temperature of the interior of the space, and not by blown air due to forced convection as in a conventional air conditioner, a person in the surrounding area never feels an uncomfortable draft sensation, and air heated or cooled by the heating element cover 13 directly warms or cools a space in front of the radiant cooling and heating apparatus 1*a*, and can efficiently warm and cool the installation space because convection occurs in the installation space. Also, the radiant cooling and heating apparatus 1*a* can prevent staining the periphery of an installation site with produced dew condensation water.

(Action of Radiant Cooling and Heating Apparatus 1*a* and Air Conditioner 2 Combined)

The air conditioning system A makes use of the advantages of each of the radiant cooling and heating apparatus and air conditioner (the air conditioner being able to make the interior of the space quickly reach a target temperature by forced convection, the radiant cooling and heating apparatus not providing a draft sensation to the user) to complement their respective disadvantages (the air conditioner providing a draft sensation to the user, the radiant cooling and heating apparatus taking a long time to make the interior of the space reach a target temperature). In addition, as shown in FIG. 6(*a*) and FIG. 6(*b*), when switching cooling and heating, the air conditioning system A performs operation by reversing the refrigerant flowing direction.

The air conditioning system A, for example, by mainly operating the air conditioner 2 at first, enables approaching a target temperature in a short time, and thereafter by mainly operating the radiant cooling and heating apparatus 1*a*, enables maintaining the temperature of the interior of the space. The fan operating time of the convective indoor machine 22 can thereby be held short to enable air conditioning that does not provide an uncomfortable draft sensation to the human body.

Also, when the radiant cooling and heating apparatus 1*a* and the air conditioner 2 are simultaneously operated, radiant heat from the radiant cooling and heating apparatus 1*a* acts directly on the body sensation of a person that is present in the nearby surrounding area, while the air conditioner 2 performs air conditioning of the entirety, and therefore, the time until comfort is provided for the person in the surrounding area can become shorter than when either the air conditioner 2 or the radiant cooling and heating apparatus 1*a* is operated alone. Further, convecting the radiant heat from the radiant cooling and heating apparatus 1*a* and blown air from the air conditioner 2 allows realizing a uniform temperature of the interior of the space in a short time.

Hereinafter, some modifications of the heating element cover components will be raised and described.

[Modification 1]

The heating element cover component 130*f* shown in FIG. 7(*a*) is a modification in the slit of the heating element cover component. A slit 135*f* of the heating element cover component 130*f* is formed in a shape that is straight with a constant width from the side of the space 132 to the direction of an inner peripheral side of an abutting portion 134*f*.

In addition, it is preferable that the slit width is narrower because the contact area with the heating element 12 is reduced if the slit width is wider. However, when the slit has a narrow width, because a large load is applied to a slit forming part of an extrusion molding die and said part is narrow and weak in strength, the die may be damaged.

Therefore, molding may first be performed with a slightly wide slit width as in the heating element cover component 130*f*, and by pressuring the heating element cover component 130*f* in a manner flattening in the short diameter direction, the slit 135*f* may be narrowed in width. The slit 135*f* after being narrowed in width can expand to a moderate width according to the size of the heating element 12, which can prevent the contact area with the heating element 12 from being excessively reduced by excessive widening of the slit width.

[Modification 2]

The heating element cover component 130*g* shown in FIG. 7(*b*) is a modification in the engaging elements of the engaging portion. The engaging elements of the engaging portion 137*g* are constituted of a guide piece 191 projecting in a hook shape and a guide groove 192 in a shape that allows storing the guide piece 191 by sliding from its end face direction. The guide piece 191 and the guide groove 192 are disposed at line-symmetrical positions using a longitudinal straight line located at a widthwise middle of an abutting portion 134*g* as an axis of symmetry, and form a pair structured to be engageable with each other.

In addition, except the point that one heating element cover component 130*g* is attached to the other heating element cover component 130*g* while being slid from its end portion side for constituting a heating element cover, the heating element cover component 130*g* is substantially the same in construction and action of other parts as the heating element cover component 130*a* (130*b*) in the foregoing, and description thereof will therefore be omitted.

[Modification 3, Modification 4, Modification 5]

FIG. 8 is referred to. FIG. 8(*c*) shows modification 3, FIG. 8(*d*) shows modification 4, FIG. 8(*e*) shows modification 5, and these are modifications in the outer shell portions of the heating element cover component. The heating element cover component 130*c* shown in modification 3 of FIG. 8(*c*) has an outer shape of a cross-section being a substantially triangular shape. The heating element cover component 130*d* shown in modification 4 of FIG. 8(*d*) has an outer shape of a cross-section being a substantially quadrilateral shape. The heating element cover component 130*e* shown in modification 5 of FIG. 8(*e*) has an outer shape of a cross-section being a substantially semicircular shape. In addition, the heating element cover components 130*c*, 130*d*, and 130*e* are substantially the same in construction and action of other parts as the heating element cover component 130*a* (130*b*) in the foregoing, and description thereof will therefore be omitted.

[Modification 6]

The radiant cooling and heating apparatus 1*b* shown in FIG. 9 is a modification where the direction in which the heating element and heating element covers are disposed is the vertical direction. As shown in FIG. 9(*b*), the respective heating element covers 13*b* enclosing the heating element 12*b* are disposed in inverted-V shape (or zigzag) configurations such that with mutually adjacent heating element covers 13*b*, the outer surfaces are not opposed to each other and mutual influence by radiant heat is thereby avoided, and the heat exchange efficiency can be improved in regard to this point as well. In addition, the radiant cooling and heating apparatus 1*b* is substantially the same in construction and action of other parts as those of the radiant cooling and heating apparatus 1*a* in the foregoing, and description thereof will therefore be omitted.

In the present embodiment, the radiant cooling and heating apparatus 1*a* includes the reflector 15, but is not limited thereto, and for example, the reflector 15 may be eliminated to make the radiant cooling and heating apparatus 1*a* emit radiant heat to both the front side and back side.

In the present embodiment, the engaging elements of the engaging portion consist of the projecting piece having a latching pawl and a projecting piece inserting portion having a latching pawl retaining portion, but other publicly known engaging structures may be adopted. Also, the engaging elements may be provided as a separable mechanism, and in that case, the heating element cover can be disassembled to improve maintenance properties of cleaning and parts replacement.

In the present embodiment, the air conditioning system A is constituted by one outdoor machine 21, one convective indoor machine 22, and one radiant cooling and heating apparatus 1*a*, but the number of each of the machines/apparatuses is not limited to the number shown in the figures.

In the present embodiment, the slit 135*a* is formed in a shape (substantially wedge shape in cross-section) that gradually narrows from the side of the space 132 being its outer peripheral side to the direction of an inner peripheral side of the abutting portion 134*a*, but is not limited thereto, and for example, it may be straight as in modification 1 described above. In addition, the slit may also be formed by post-processing such as cutting after forming a heating element cover component without a slit (which is the same as the heating element cover component 130*a* in parts other than the slit).

In the present embodiment, the heating element cover component 130*a*, 130*b* has an outer shape of a cross-section being a slightly flat, substantially semielliptical shape, but is not limited thereto, and for example, it may be appropriately set into various shapes as in modification 3, modification 4, and modification 5 described above.

In the present embodiment, the direction in which the heating element 12 and the heating element covers 13 are disposed is the horizontal direction, but is not limited thereto, and for example, it may be the vertical direction as in modification 6 described above, and can be appropriately changed to various directions.

In the present embodiment, the heating element 12 is a meandering pipe as described above, but is not limited thereto, and for example, it may be a ladder-shaped heating element having a pair of tubular bodies extending in the up-and-down direction and a plurality of tubular heat generating portions laid so as to flow liquid between the tubular bodies. Also, the connecting portion 181 and the connecting portion 182 of the heating element 12 are provided in the positions described above, but are not limited thereto, and the positions and numbers thereof can be appropriately set.

In the present embodiment, the inclination angle when attaching the heating element cover 13 to the support frame 11 is 45°, but is not limited thereto, and for example, it suffices to be in a range of 1° to 89°. Further, the inclination angle of the heating element cover 13 described above is preferably in a range of 35° to 70°, because, if in this inclination angle range, as to be described later, a radiation flux generated from the side to be a lower surface side of the heating element cover 13 is likely to head for a front-side floor surface from the front side of the radiant cooling and heating apparatus 1*a*.

In the present embodiment, the heating element cover component 130*a*, 130*b* is applied at its inner and outer surfaces with knurling and an alumite processing, but is not limited thereto, and for example, one type or a combination of a plurality of types of processing or coating selected from among other types of coating including heat dissipation coating, far infrared ray emission coating, and coating having a deodorizing function, an antibacterial function, or a volatile organic compound adsorption-decomposition function can be applied to provide various functions for the heating element cover. Also, such processing does not eliminate being applied only to either of the inner and outer surfaces described above.

In greater detail, by applying a heat dissipation coating, the heating element cover is improved in heat dissipation, and if a far infrared ray emission coating is applied to the heating element cover, the far infrared rays emitted therefrom, together with the radiant heat, cause indoor temperature adjustment to be performed efficiently. Further, by applying a coating having a deodorizing function, an antibacterial function, or a volatile organic compound adsorption-decomposition function to the heating element cover, the maintenance of the radiant cooling and heating apparatus is made simpler and comfortable use can be realized by these functions.

Further, there may be such a form that, of the outer surface (outer shell portion 131*a*, 131*b*) of the heating element cover 13, a processing such as a water-repelling processing or a guide groove along which dew condensation water is likely to flow down is applied to a region facing the side of the reflector 15, and a processing to enhance a heat dissipation effect such as knurling is applied to a region facing the side to be the front of the radiant cooling and heating apparatus 1*a*. In this case, dew condensation water produced on that heating element cover 13 or dew condensation water that has dripped from the heating element cover 13 located at an upper height is likely to flow down to the side of the reflector 15, and is unlikely to head for the side to be the front of the radiant cooling and heating apparatus 1*a*. In addition, a measure against dew condensation water by applying a hydrophilization processing such as blasting to a surface of the region facing the side of the reflector 15 is also not excluded. On the other hand, if knurling, etc., is applied to the side of the outer surface of the heating element cover 13 to be the front of the radiant cooling and heating apparatus 1*a*, the efficiency of heat dissipation to a person or space located on the front side is excellent.

In the present embodiment, the abutting portion 134*a*, 134*b* is semicircular as viewed in end elevation, but is not limited thereto, and for example, if the heating element is a triangular or quadrilateral angular pipe, it may be such an angular shape so as to be able to sandwich the same.

In the present embodiment, the panel body 17 is attached to below the front side of the front of the radiant cooling and heating apparatus 1*a*, but is not limited thereto, and there may be a form in which the panel body is attached to above the front side of the radiant cooling and heating apparatus 1*a* when a piping portion (not shown) or the like is provided in an upper portion.

In the present embodiment, a refrigerant is used as a flowable heating medium, but the flowable heating medium is not limited thereto, and examples thereof include warm (hot) water, steam, cold water, liquid phase refrigerants, gas-liquid two phase refrigerants, and gas phase refrigerants of hydrochlorofluorocarbon, hydrofluorocarbon, etc., but the flowable heating medium is not limited thereto, and other publicly known flowable heating media may be adopted. In addition, when the flowable heating medium is warm water or cold water, handling is easier than when it is oil or a chemical, and there is less environmental burden at disposal.

In the present embodiment, the radiant cooling and heating apparatus 1*a* uses, as the flowable heating medium, a refrigerant that is in common with the refrigerant circuit of the air conditioner 2, but the radiant cooling and heating apparatus 1*a* and the air conditioner 2 may respectively use exclusive refrigerants, and the radiant cooling and heating apparatus 1*a* and the air conditioner 2 may respectively use different flowable heating media.

In the present embodiment, the numerical value of the outer diameter of each horizontal part of the heating element 12 is provided so as to become 105 when the numerical value of the inner diameter of a circular region constituted by the abutting portion 134*a* and the abutting portion 134*b* is provided as 100, but it is not limited thereto, and for example, the numerical value of the outer diameter of each horizontal part of the heating element 12 is preferably in a range of 100 to 112. This is because a gap is produced between the heating element 12 and the abutting portions 134*a* and 134*b* if the numerical value of the outer diameter of each horizontal part of the heating element 12 is 100 or less, and if the numerical value is 112 or more, it is highly likely that the heating element cover 13 excessively swells in the short diameter direction to be deformed so as to open at an outer peripheral part where the heating element cover components 130*a* and 130*b* are in contact or to deform the heating element 12.

In addition, it is indeed possible in the present embodiment to attach the heating element cover 13 by using a heat transfer member such as a heat radiation grease as is conventionally done even when the numerical value of the outer diameter of each horizontal part of the heating element 12 is 99 or less when the numerical value of the inner diameter of a circular region constituted by the abutting portion 134*a* and the abutting portion 134*b* is provided as 100, but for the reason described above, it is preferable that the inner diameter of a circular region constituted by the respective abutting portions is the same as or slightly larger than the outer diameter of each horizontal part of the heating element.

In the present embodiment, when the abutting portion 134*a*, etc., expands in the direction in which the same swells, the connecting portions 136 (particularly, the connecting portion 136 on the side where the projecting piece inserting portion 140*a* is formed) is also deformed by warping (refer to P4 to P7 in FIG. 5(*b*) for the direction of deformation), and the warping deformation occurs, for example, about where the outer shell portion 131*a*, etc., and the connecting portion 136 connect and/or about a middle (refer to FIG. 4) of the outer periphery of the outer shell portion 131*a*, etc., in some cases.

In the present specification and claims, the term "radiant" may be replaced by "radiation."

Note that the terms and expressions used in the present specification and claims are merely descriptive, and not restrictive by any means, and not intended to exclude terms and expressions equivalent to the features and portions thereof described in the present specification and claims. Also, as a matter of course, various modifications are possible within the scope of the technical ideas of the present invention.

DESCRIPTION OF SYMBOLS

A: air conditioning system, F: installation surface, 1*a*, 1*b*: radiant cooling and heating apparatus, 11: support frame, 110: support portion, 12, 12*b*: heating element, 13, 13*b*: heating element cover, 130*a*, 130*b*, 130*c*, 130*d*, 130*e*, 130*f*, 130*g*: heating element cover component, 131*a*, 131*b*, 131*c*, 131*d*, 131*e*: outer shell portion, 132: space, 133*a*, 133*b*, 133*g*: joining portion, 134*a*, 134*b*, 134*f*, 134*g*: abutting portion, 135*a*, 135*b*, 135*f*: slit, 136: connecting portion, 138*a*, 138*b*: projecting piece, 139*a*, 139*b*: latching pawl, 140*a*, 140*b*: projecting piece inserting portion, 141*a*, 141*b*: latching pawl retaining portion, 15: reflector, 151: reflecting surface, 152: guide plate, 16: water receiving portion, 17: panel body, 181, 182: connecting portion, 191: guide piece, 192: guide groove, 2: air conditioner, 21: outdoor machine, 211: compressor, 212: outdoor side heat exchanger, 213: expansion valve, 214: four-way switching valve, 22: convective indoor machine, 221: indoor side heat exchanger, 23: refrigerant piping, 9: heating element cover, 90: flow pipe, 91*a*, 91*b*: shell member, 92*a*, 92*b*: abutting portion, 93*a*, 93*b*: projecting piece portion, 94*a*, 94*b*: recess portion

What is claimed is:

1. A heating element cover component comprising:

a hollow outer shell portion of a predetermined length, having predetermined rigidity and thermal conductivity;

a substantially half-pipe shaped abutting portion formed with a predetermined thickness at a predetermined site of the outside of the outer shell portion in parallel with a longitudinal direction of the outer shell portion, having flexibility and thermal conductivity, and with a slit penetrating in a thickness direction formed over the entire length in parallel with the longitudinal direction;

a connecting portion having flexibility and thermal conductivity, connecting opposed edges of the abutting portion parallel to the longitudinal direction with the outer shell portion;

an engaging portion constituted by engaging elements that are disposed at line-symmetrical positions using a longitudinal straight line located at a widthwise middle of the abutting portion as an axis of symmetry to form a pair structured to be engageable with each other; and wherein the slit is formed in a shape that gradually narrows from a side of a hollow region in the outer shell portion to a direction of an outer surface of the abutting portion.

2. The heating element cover component according to claim 1, wherein the outer shell portion, the abutting portion, the connecting portion, and the engaging portion are made of aluminum or made of an aluminum alloy, and an alumite processing is applied to an outer surface of the outer shell portion, the abutting portion, the connecting portion, and the engaging portion and an inner surface of the outer shell portion.

3. The heating element cover component according to claim 1, wherein one of the engaging elements is a projecting piece that projects in a direction opposite to the outer shell portion and is formed with a latching pawl, and the other of the engaging elements is a projecting piece inserting portion that is set to a size capable of receiving the projecting piece and is capable of latching the latching pawl.

4. A heating element cover having a structure of a pair of heating element cover components, each including a hollow outer shell portion of a predetermined length, having predetermined rigidity and thermal conductivity, a substantially half-pipe shaped abutting portion formed with a predetermined thickness at a predetermined site of the outside of the outer shell portion in parallel with a longitudinal direction of the outer shell portion, having flexibility and thermal conductivity, and with a slit penetrating in a thickness direction formed over the entire length in parallel with the longitudinal direction, a connecting portion having flexibility and thermal conductivity, connecting opposed edges of the abutting portion parallel to the longitudinal direction with the outer shell portion, and an engaging portion constituted by engaging elements that are disposed at line-symmetrical positions using a longitudinal straight line located at a widthwise middle of the abutting portion as an axis of symmetry to form a pair structured to be engageable with each other, of which the engaging elements mutually paired are engaged with each other in a manner joining the abutting portions together with the engaging elements made face to face with each other; and wherein the slit is formed in a shape that gradually narrows from a side of a hollow region in the outer shell portion to a direction of an outer surface of the abutting portion.

5. A radiant cooling and heating apparatus comprising: a support frame; a heating element which is disposed in an in-between region sandwiched by the support frame or surrounded by the support frame, inside of which a flowable heating medium can flow through, and which consists of a plurality of tubular parts laid thereacross at an interval; and a heating element cover having a structure of a pair of heating element cover components installed for each of the tubular parts of the heating element, and each including a hollow outer shell portion of a predetermined length, having predetermined and thermal conductivity, a substantially half-pipe shaped abutting portion formed with a predetermined thickness at a predetermined site of the outside of the outer shell portion in parallel with a longitudinal direction of the outer shell portion, having flexibility and thermal conductivity, and with a slit penetrating in a thickness direction formed over the entire length in parallel with the longitudinal direction, a connecting portion having flexibility and thermal conductivity, connecting opposed edges of the abutting portion parallel to the longitudinal direction with the outer shell portion, and an engaging portion constituted by engaging elements that are disposed at line-symmetrical positions using a longitudinal straight line located at a widthwise middle of the abutting portion as an axis of symmetry to form a pair structured to be engageable with each other, of which the abutting portions are made mutually face to face with each other to sandwich each tubular part of the heating element therebetween, and the engaging elements mutually paired are engaged with each other with the engaging elements made face to face with each other; and wherein the slit is formed in a shape that gradually narrows from a side of a hollow region in the outer shell portion to a direction of an outer surface of the abutting portion.

6. An air conditioning system comprising: a radiant cooling and heating apparatus including a support frame, a heating element which is disposed in an in-between region sandwiched by the support frame or surrounded by the support frame, inside of which a flowable heating medium can flow through, and which consists of a plurality of tubular parts laid thereacross at an interval, a heating element cover having a structure of a pair of heating element cover components installed for each of the tubular parts of the heating element, and each including a hollow outer shell portion of a predetermined length, having predetermined rigidity and thermal conductivity, a substantially half-pipe shaped abutting portion formed with a predetermined thickness at a predetermined site of the outside of the outer shell portion in parallel with a longitudinal direction of the outer shell portion, having flexibility and thermal conductivity, and with a slit penetrating in a thickness direction formed over the entire length in parallel with the longitudinal direction, a connecting portion having flexibility and thermal conductivity, connecting opposed edges of the abutting portion parallel to the longitudinal direction with the outer shell portion, and an engaging portion constituted by engaging elements that are disposed at line-symmetrical positions using a longitudinal straight line located at a widthwise middle of the abutting portion as an axis of symmetry to form a pair structured to be engageable with each other, of which the abutting portions are made mutually face to face with each other to sandwich each tubular part of the heating element therebetween, and the engaging elements mutually paired are engaged with each other with the engaging elements made face to face with each other; and an air conditioner to be operated in combination with the radiant cooling and heating apparatus, including a refrigerant circuit in which a compressor, an expansion valve, a flow path switching valve, an indoor side heat exchanger, and an outdoor side heat exchanger are connected by piping to circulate a refrigerant to perform a refrigeration cycle, said radiant cooling and heating apparatus being incorporated in said refrigerant circuit, and supplying air that has undergone heat exchange with the refrigerant by the indoor side heat exchanger to an indoor space by a fan; and wherein the slit is formed in a shape that gradually narrows from a side of a hollow region in the outer shell portion to a direction of an outer surface of the abutting portion.

* * * * *